US006322190B1

(12) United States Patent
Kono et al.

(10) Patent No.: US 6,322,190 B1
(45) **Date of Patent: *Nov. 27, 2001**

(54) INK-JET PRINTING APPARATUS CAPABLE OF DETECTING EJECTION FAILURE OF INK-JET HEAD

(75) Inventors: Takeshi Kono, Kawasaki; Atsushi Saito, Yokohama; Takashi Ono, Yokosuka; Shinichiro Koori, Kawasaki; Yukio Nohata, Yokohama; Shigeyuki Sugiyama, Hiratsuka, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 131 days.

(21) Appl. No.: 08/651,905

(22) Filed: May 21, 1996

(30) Foreign Application Priority Data

May 22, 1995 (JP) ..... 7-122500

(51) Int. Cl.[7] ..... B41J 2/01
(52) U.S. Cl. ..... 347/19
(58) Field of Search ..... 347/5, 9, 12, 13, 347/14, 19, 40

(56) References Cited

U.S. PATENT DOCUMENTS

| | | | |
|---|---|---|---|
| 4,313,124 | 1/1982 | Hara | 346/140 R |
| 4,345,262 | 8/1982 | Shirato et al. | 346/140 R |
| 4,459,600 | 7/1984 | Sato et al. | 346/140 R |
| 4,463,359 | 7/1984 | Ayata et al. | 346/1.1 |
| 4,558,333 | 12/1985 | Sugitani et al. | 346/140 R |
| 4,608,577 | 8/1986 | Hori | 346/140 R |
| 4,723,129 | 2/1988 | Endo et al. | 346/1.1 |
| 4,740,796 | 4/1988 | Endo et al. | 346/1.1 |
| 5,030,317 | 7/1991 | Noguchi | 156/630 |
| 5,124,720 * | 6/1992 | Schantz | 347/19 |
| 5,430,306 * | 7/1995 | Ix | 250/573 |
| 5,430,469 * | 7/1995 | Shioya et al. | 347/15 |
| 5,455,608 * | 10/1995 | Stewart et al. | 347/23 |
| 5,477,244 | 12/1995 | Shibata et al. | 347/19 |

FOREIGN PATENT DOCUMENTS

| | | | |
|---|---|---|---|
| 3244112 | 5/1984 | (DE) . | |
| 0110634 | 6/1984 | (EP) . | |
| 0447262 | 9/1991 | (EP) . | |
| 0470813 | 2/1992 | (EP) . | |
| 2276477 * | 9/1994 | (GB) | 347/13 |
| 54-56847 | 5/1979 | (JP) . | |
| 59-123670 | 7/1984 | (JP) . | |
| 59-138461 | 8/1984 | (JP) . | |
| 60-712620 | 4/1985 | (JP) . | |
| 1310965 * | 12/1989 | (JP) | 347/19 |

OTHER PUBLICATIONS

English translation of Miura et al. (JP 1–310,965), 12/15/8.*

* cited by examiner

*Primary Examiner*—John Barlow
*Assistant Examiner*—Craig A. Hallacher
(74) *Attorney, Agent, or Firm*—Fitzpatrick, Cella, Harper & Scinto

(57) ABSTRACT

A plurality of ejection openings of an ink-jet head are divided into four blocks and ink ejection is performed for each block. An output of a photosensor which depends upon a number of ejected ink droplets interrupting light at a photosensor is sampled. On a basis of the sensor output, judgement is made whether ejection failure is present of the relevant block. This in ejection openings process is performed sequentially for other blocks. By this, even when a given rate of error is present in detecting precision of the photosensor, since overall number of ejection openings for which the detection is made is smaller, the number of faulty ejection openings which cannot be detected can be made smaller.

21 Claims, 6 Drawing Sheets

INK-JET PRINTING APPARATUS CAPABLE OF DETECTING EJECTION FAILURE OF INK-JET HEAD

BACKGROUND OF THE INVENTION

1. Field of the Invention

The present invention relates generally to an ink-jet printing apparatus. More specifically, the invention relates to an ink-jet printing apparatus to be employed in a facsimile apparatus, a printer, a copy machine and so forth.

2. Description of Related Art

As such type of apparatus, an ink-jet printing apparatus as employed in a facsimile apparatus will be discussed with reference to FIG. 1.

A plurality of printing papers P are stacked in a cassette 51 and are fed one by one by means of a feeder roller 52 into a transporting path formed by a transporting roller 53. The printing paper P is further transported to a printing portion B by rotation of the transporting roller 53. The printing portion B has an ink-jet head in which are arranged a plurality of (64, for example) ejection openings in transporting direction (auxiliary scanning direction) of the printing paper P and which is provided for scanning in a direction perpendicular to the transporting direction (primary scanning direction) so that ink is ejected toward the printing paper P so as to print image and so forth. The printed printing paper P is transported to a discharge portion along a lower guide 55 by a discharge roller pair 54 arranged at downstream side of the printing portion B in the transporting path and discharged to a discharge paper stacker 58 as discharge stacking portion by means of a discharge roller 56 and a discharge roll 57 to be stacked therein.

Various systems for performing printing on printing media, such as paper, OHP sheet and so forth have been known. Amongst those, an ink-jet printing system to be employed in the conventional apparatus set forth above is to directly eject into toward the printing medium. Such ink-jet system is advantageous in relatively low running cost and low level of noise to be generated associated with a printing operation. On the other hand, in the ink-jet system, it becomes necessary to quickly detect running out of the ink or ejection failure for preventing printing failure from occurring.

In the ink-jet printing apparatus, as a method for detecting faulty condition of ejection, such as running out of the ink, ejection failure due to plugging, clogging and so forth, there has been known a technology for passing the ejected ink droplet between a light emitting element and a photo-sensing element of a transmission type photosensor and detecting ejection failure based on whether the light between the elements is interrupted or not.

In one example of construction of the above-mentioned transmission type photosensor, a lens is integrally formed on a light emitting surface of the light emitting element. By this, substantially parallel light is projected toward the photo-sensing element. On the other hand, in a photo-sensing surface of the photo-sensing element, an aperture in the order of 0.7 mm×0.7 mm is formed on a light axis by a molding member. By this, in the overall range between photo-sensing and light emitting, detecting range is limited at approximately 0.7 mm in height and approximately 0.7 mm in width. Further, the light emitting element and the photo-sensing element are arranged so that a light axis extending therebetween is in parallel to ejection opening array of the ink-jet head and intersects with a flying path of the ejected ink droplet. Also, a distance between the light emitting element and the photo-sensing element is set to be wider than a range of the ejection opening array. By this, all of the ink droplets ejected from respective ejection openings of the ink-jet head may pass through the detection range between the light emitting element and the photo-sensing element. Thus, when the ink ejection is performed normally and the ink droplet passes the detection range, the ink droplet interrupts the light beam from the light emitting side to reduce the amount of light reaching the photo-sensing side to cause variation of output of the photo-sensing element. The ejected ink droplet is in the form of a fine liquid droplet having a diameter less than or equal to 50 Am. Therefore, normally, single ink droplet ejected from single ejection opening may not interrupt the light emitted from the light emitting side completely. Instead, light interruption ratio is gradually increased depending upon number of ejection openings ejecting ink. Accordingly, when the output of the transmission type photosensor varies in a magnitude greater than or equal to a given amount, ink ejection is judged as normal. Conversely, when the variation magnitude of the transmission type photosensor is less than or equal to the given amount, failure of ink ejection can be detected.

When ejection failure is detected, the facsimile apparatus prohibits reception of subsequent printing operation command until operation for recovery of ejection is performed and inhibits reception of data, or accumulates received data in a memory to previously prevent the data from being lost. It has been known that a detection operation of ejection failure performed after completion of printing for each page is effective.

The technology for detecting ejection failure may perform detection without adding any special parts for the ink-jet head. Therefore, it can be employed as effective means for detection of ejection failure.

However, in the above-described prior art, the number of ejection openings normally performing ejection and variation amount of the output of the photosensor are substantially proportional. On the other hand, output of the transmission type photosensor normally fluctuates approximately 20% at maximum due to fluctuation of performance of the light emitting element and the photo-sensing element, fluctuation of play in assembling the elements and so forth. Therefore, there can not be detected an occurrence of ejection failure even when partial ejection failure of a plurality of ejection openings occurs.

For example, in the case that an ink-jet head having 64 ejection openings and the photosensor which causes output higher than that set with respect to actual light receiving amount, are used, even if 12 ejection openings corresponding to less than 20% of the number of overall ejection openings causes ejection failure, lowering of the sensor output corresponding to ejection failure can not be detected accurately, and therefore it was impossible to detect the occurrence of partial ejection failure of these ejection openings. In such case, printing can not only be performed in the condition causing ejection failure to cause degradation of quality of the printed product, but printing is performed in a condition that a part of received data are not printed and a problem that it needs to request retransmission of the data is raised especially on the facsimile apparatus.

Further, magnitude of fluctuation of the photosensor output is determined with taking a cost as important factor. Therefore, if steps for selecting elements constituting the photosensor and adjusting the photosensor are to be neglected for lowering of cost, the above-described fluctuation is increased to make a condition regarding the photosensor worse. Therefore, the construction for detecting ejection failure in the prior art serves as hazard for cost down.

On the other hand, even if partial failure of the ejection openings is detected by making fluctuation of sensor output smaller in the construction for detecting ejection failure in the prior art, since failure detecting is done as detection of ejection failure of the overall ink-jet head, such detection may cause prohibiting of reception of the subsequent printing request.

It is possible that 16 ejection openings, which is one fourth of 64 ejection openings, have ejection failure and thus 48 ejection openings operate normally. In such case, despite the fact that printing can be performed by employing normally operating 48 ejection openings, printing operation is inhibited and inhibit reception of the receiving data to perform operation accumulating the received data in the memory or so forth. Particularly, the facsimile apparatus is frequently used for automatic reception without monitoring by an operator. Therefore, even when the reception data is stored in the memory under printing inhibited condition, it may occur that the facsimile apparatus must be situated into the reception inhibiting state when an amount of data more than capacity of the memory is received, due to limited capacity of the memory to cause significant inconvenience of the facsimile apparatus.

SUMMARY OF THE INVENTION

Therefore, it is an object of the present invention to provide an ink-jet printing apparatus and a facsimile apparatus which can certainly detect ejection failure even when relatively inexpensive photosensor is employed, can detect a portion where failure of ejection is caused to increase freedom in subsequent process, is convenient for use and is highly reliable.

Another object of the present invention is to provide an ink-jet printing apparatus and a facsimile apparatus which performs detection of ejection failure of a plurality of ejection openings for each block consisting of a given number of ejection openings for reducing number of overall ejection openings subjecting detection of ejection failure, so as to reduce the number of ejection openings for which detection of ejection failure becomes impossible due to fluctuation of output of the photosensor, and permit to continue printing operation using other blocks even when ejection failure is detected in one block.

In a first aspect of the present invention, there is provided an ink-jet printing apparatus for performing printing by ejecting an ink toward a printing medium employing an ink-jet head having a plurality of ink-jet openings, comprising:

detection means including a light emitting element and a photo-sensing element;

detecting ejection means for ejecting the ink from respective ejection openings of the ink-jet head across a light path formed between the light emitting element and the photo-sensing element in the detection means; and ejection failure detecting means for controlling the detecting ejection means to perform ejection from lesser number of ejection openings than the number of ejection openings of the ink-jet head, and for detecting, ejection failure of the ejection openings through which ejection is performed by the detecting ejection means, on a basis of an output of the detection means relative to a predetermined value set corresponding to the number of ejection openings through which ejection is performed by the detecting ejection means.

In a second aspect of the present invention, there is provided an ink-jet printing apparatus for performing printing by ejecting an ink toward a printing medium employing an ink-jet head having a plurality of ink-jet openings, comprising:

detection means including a light emitting element and a photo-sensing element;

detecting ejection means for ejecting the ink from respective ejection openings of the ink-jet head across a light path formed between the light emitting element and the photo-sensing element in the detection means;

ejection failure detecting means for controlling the detecting ejection means to perform ejection from lesser number of ejection openings than number of ejection openings of the ink-jet head, and for detecting ejection failure of the ejection openings through which ejection is performed by the detecting ejection means, on a basis of an output of the detection means relative to a predetermined value set corresponding to the number of ejection openings through which ejection is performed by the detecting ejection means; and printing control means for performing printing employing the ejection openings other than the ejection openings for which ejection failure is detected, when ejection failure is detected by the ejection failure detecting means.

In a third aspect of the present invention, there is provided a facsimile apparatus for performing a printing on a basis of a received data employing an ink-jet head having a plurality of ink ejection openings, comprising:

detection means including a light emitting element and a photo-sensing element;

detecting ejection means for ejecting the ink from respective ejection openings of the ink-jet head across a light path formed between the light emitting element and the photo-sensing element in the detection means;

ejection failure detecting means for controlling the detecting ejection means to perform ejection from lesser number of ejection openings than number of ejection openings of the ink-jet head, and for detecting ejection failure of the ejection openings through which ejection is performed, by the detecting ejection means, on the basis of an output of the detection means relative to a predetermined value set corresponding to the number of ejection openings through which ejection is performed by the detecting ejection means; and reception control means for storing received data in a memory after detecting ejection failure, when ejection failure is detected by the ejection failure detecting means.

In a fourth aspect of the present invention, there is provided a facsimile apparatus for performing a printing on a basis of a received data employing an ink-jet head having a plurality of ink ejection openings, comprising:

detection means including a light emitting element and a photo-sensing element;

detecting ejection means for ejecting the ink from respective ejection openings of the ink-jet head across a light path formed between the light emitting element and the photo-sensing element in the detection means;

ejection failure detecting means for controlling the detecting ejection means to perform ejection from lesser number of ejection openings than number of ejection openings of the ink-jet head, and for detecting ejection failure of the ejection openings through which ejection is performed by the detecting ejection means, on a basis of an output of the detection means relative to a predetermined value set corresponding to the number of ejection openings through which ejection is performed by the detecting ejection means; and control means for performing printing employing ejection openings other than ejection openings at which ejection failure is detected and storing received data in a memory after detecting ejection failure, when ejection failure is detected by the ejection failure detecting means.

BRIEF DESCRIPTION OF THE DRAWINGS

The present invention will be understood more fully from the detailed description given herebelow and from the accompanying drawings of the preferred embodiment of the invention, which, however, should not be taken to be limitative to the present invention, but are for explanation and understanding only.

In the drawings.

DESCRIPTION OF THE PREFERRED EMBODIMENT

The present invention will be discussed hereinafter in detail in terms of the preferred embodiment with reference to the accompanying drawings, particularly to FIGS. 2 to 6. In the following description, numerous specific details are set forth in order to provide a thorough understanding of the present invention. It will be obvious, however, to those skilled in the art that the present invention may be practiced without these specific details. In other instance, well-known structures not shown in detail in order not to unnecessarily obscure the present invention.

First Embodiment

Figure 1:
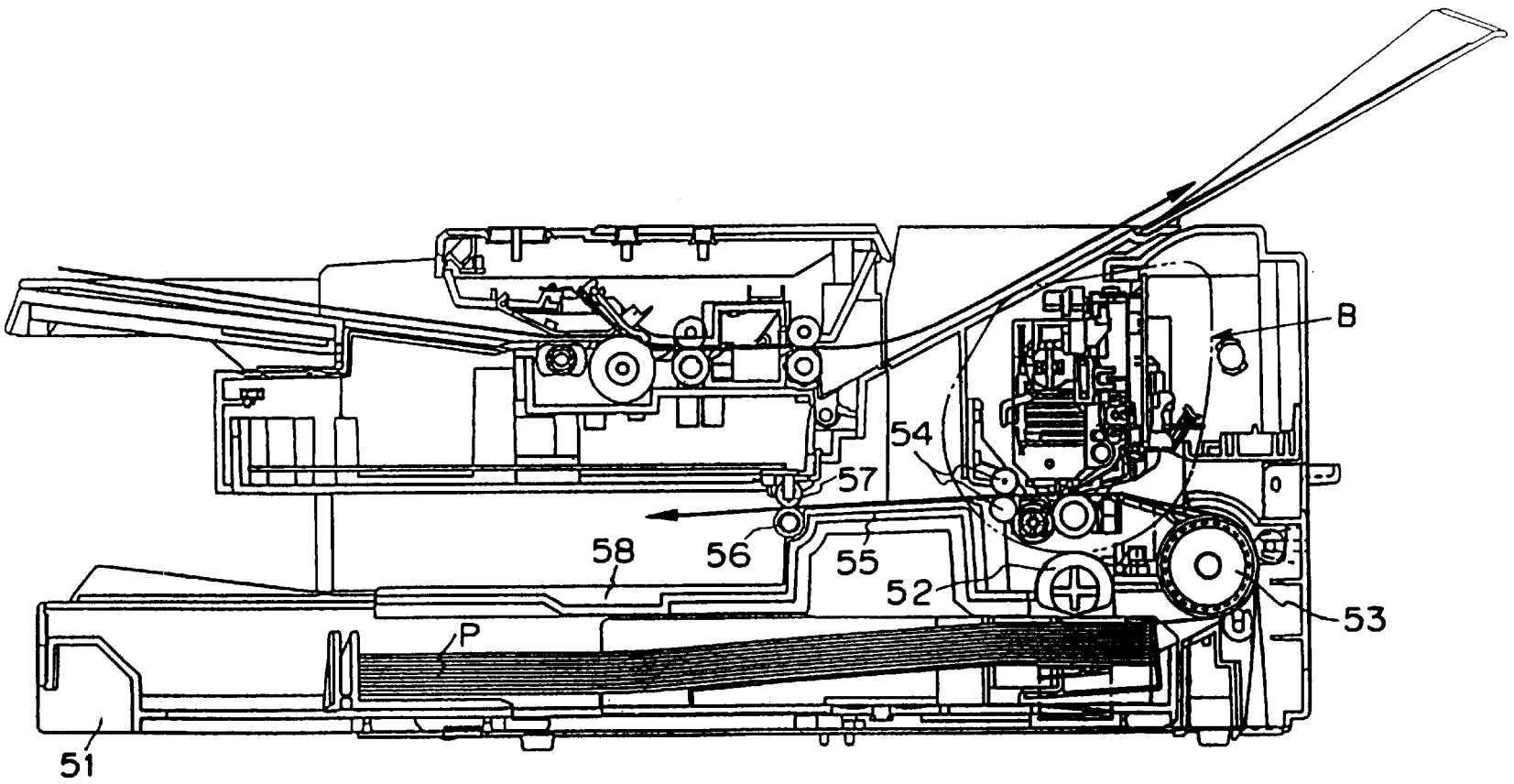
FIG. 1 is a section of one example of the conventional facsimile apparatus as viewed from the side.
Figure 2:
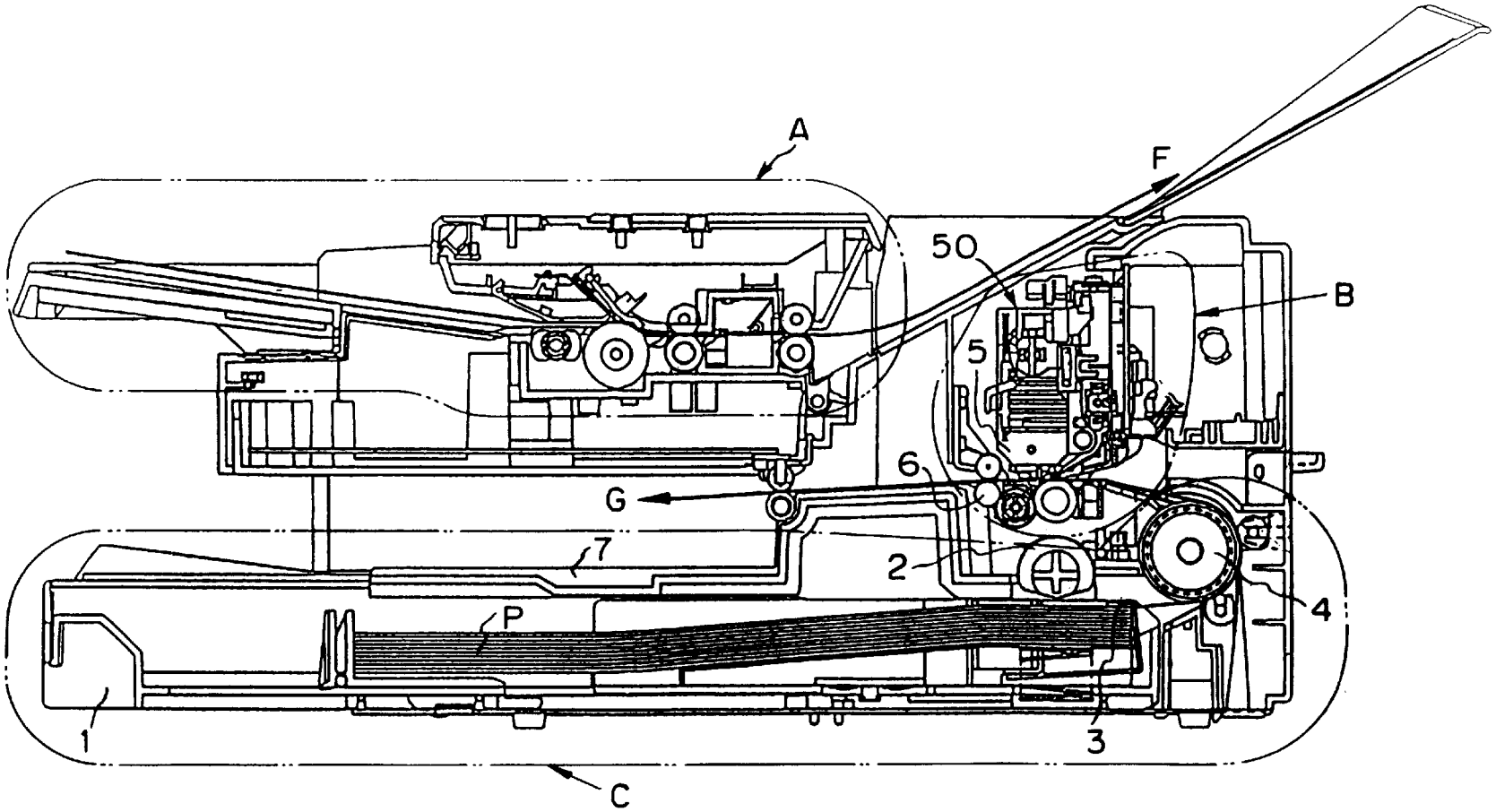
FIG. 2 is a section of one embodiment of a facsimile apparatus according to the present invention, as viewed from the side.

FIG. 2 is a section showing one embodiment of a facsimile apparatus, in which the present invention is applied.

At first, discussion will be given for general construction of the facsimile apparatus with reference to FIG. 2. In FIG. 2, a reference sign A denotes a reading portion for optically reading an original, a reference sign B denotes a printing portion employing an ink-jet printing apparatus, a reference sign C denotes a feeder portion separating a sheet, such as printing paper or so forth stacked in a sheet cassette and supplying the sheet to the printing portion B. It should be noted that a mechanical construction of respective parts are similar to those known in the art.

A transporting path of a printing paper P is as shown by arrow G. More specifically, the printing paper P stacked in a feeder cassette 1 of the feeder portion C is picked up by a feeder roller 2 and a separation claw 3 and fed into the printing portion B by a transporting roller 24 as transporting means. In the printing portion B, ink is ejected from an ink-jet head 5 for performing printing. Subsequently, after transporting a certain distance within the apparatus, the printed paper is discharged and stacked in a discharge paper stacker 7 by a discharge roller 6.

Next, discussion will be given for detailed construction of the printing portion B with reference to FIG. 3.

Figure 3:
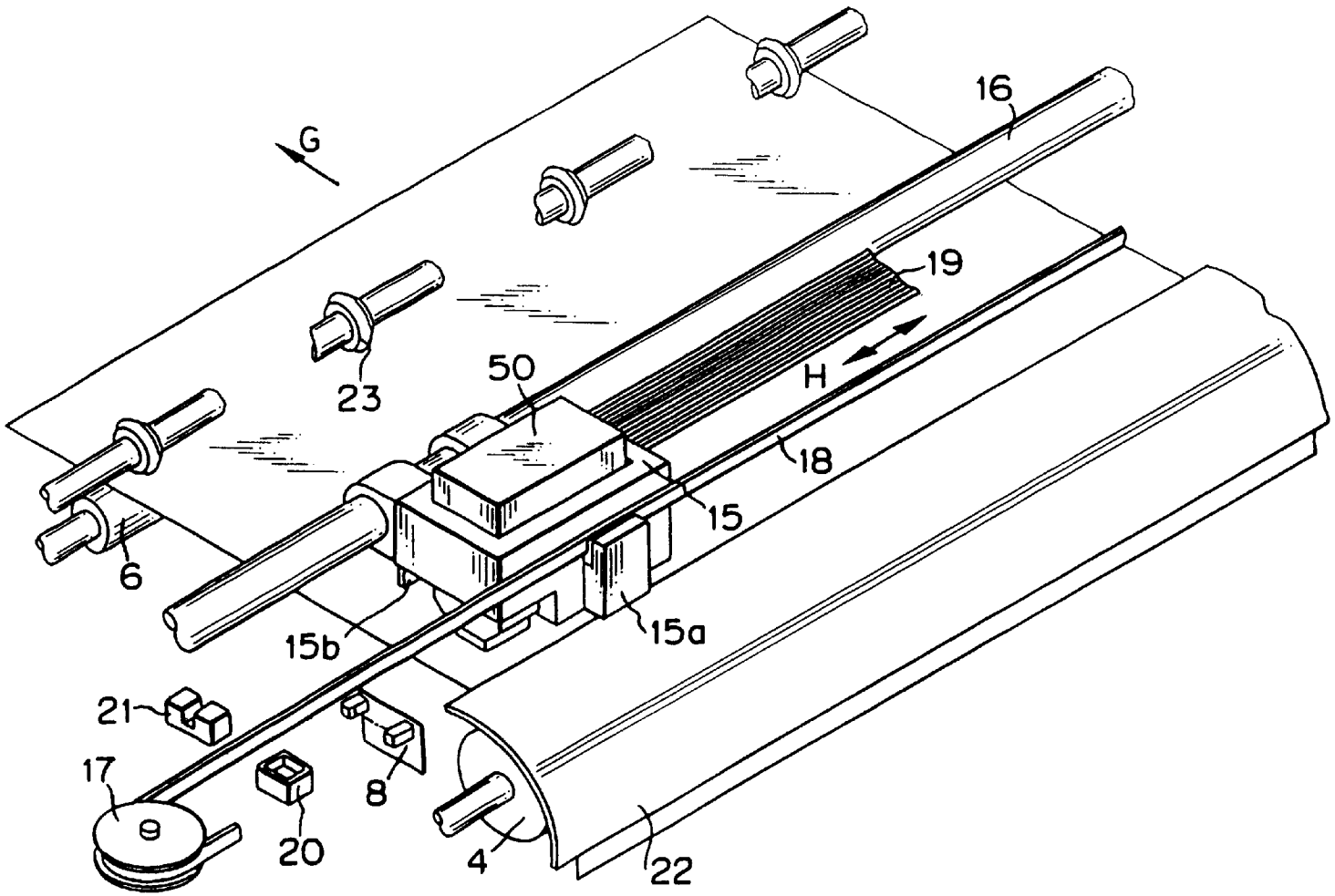
FIG. 3 is a perspective view showing a detail of a printing portion in an embodiment of the facsimile apparatus.

In FIG. 3, the shown embodiment of the ink-jet head 5 (not shown in FIG. 3) is the type formed integrally with an ink tank for replacement together with the ink tank when ink in the tank is run out. Namely, the ink-jet head and the ink tank construct an ink-jet cartridge 50. The ink-jet head 5 arranges 64 ejection openings in one row at a density of 360 DPI. Electro-thermal transducing elements are arranged in respective ink passages corresponding to respective ejection openings. Heat generation of the electro-thermal transducing element causes film boiling to generate a bubble so that ink is ejected through the ejection opening by pressure of the bubble.

A carriage 15 detachably mounting the ink-jet cartridge 50 is slidably held by a guide bar 16 and abutting portion 15*a* for reciprocal movement in a direction perpendicular to the transporting direction (the transporting direction is called auxiliary scanning direction, and shown by an arrow G in FIG. 3), namely in a primary scanning direction (shown by an arrow H in FIG. 3). Reciprocal motion of the carriage 15 is performed by means of a pulley 17 driven by a carriage motor 30 (see FIG. 4) and a timing belt 18 wound therearound. At this time, an ejection signal and electric power to be supplied to the ink-jet head 5 is supplied from an electrical circuit or so forth in a main body of the facsimile apparatus through a flexible cable 19.

Further, a cap 20 is arranged at a position corresponding to a position of the carriage 15 in stand-by state (a home position) and moves up and down as required to cover a surface of the ink-jet head 5 where the ejection openings are provided at the upwardly moved position for avoiding evaporation of ink and deposition of dust. Here, control of relative position between the ink-jet head 5 and the cap 20 in the primary direction is performed with a carriage home sensor 21 and a light shielding plate 15*b* provided on the carriage 15. As the carriage home sensor 21 a transmission type photo-interrupter is employed. When the carriage 15 is moved to the standby position (home position), a part of a light irradiated from the carriage home sensor 21 is interrupted by the light shielding plate 15*b*. Utilizing this, the predetermined position where the ink-jet head 5 and the cap 20 are mutually opposing is detected.

The printing paper P is fed upwardly from the lower side of the printing portion in the drawing. Then, the printing paper P is deflected into the horizontal direction by the transporting roller 4 and a paper guide 22 to be transported in the direction of arrow G. The transporting roller 4 and the discharge roller 6 are respectively driven by a feeder motor 31 (see FIG. 4) for feeding the printing paper in the direction of arrow G at high precision in synchronism with reciprocating motion of the carriage 15. Spurs 23 are arranged at a plurality of positions opposing to the discharge roller 6 by a not shown bearing member with a given interval in a direction parallel to the primary scanning direction so that they may guide and transport the printing paper immediately after printing without affecting the printed image even when they contact an image that is not yet fixed. Therefore, the spurs 23 are formed of a material having high water repelling characteristics and designed to contact with the printing paper P only at a teeth-like peripheral portion.

A photosensor 8 is arranged at a position between the cap 20 and one end of the printing paper P to be transported and corresponding to the range where the ejection opening array of the ink-jet head 5 passes. The photosensor 8 is a transmission type photointerrupter capable of optically detecting the ink droplet ejected from each ejection opening of the ink-jet head 5. Ink ejection failure of the ink-jet head can be judged on the basis of the output of the photosensor 8.

The photosensor 8 to be employed in the shown embodiment uses an infrared ray LED as the light emitting element. On the light emitting surface of the LED, a lens is formed integrally. By this, a substantially parallel light beam can be projected. As the photo-sensing element of the photosensor 8, a photo-transistor is employed. On a photo-sensing surface of the photo-sensing element is formed an aperture of 0.7 mm×0.7 mm on the light axis, by a molding method. Thus, in overall range between photoreceiving and light emitting, a detection range is restricted at 0.7 mm in height and 0.7 mm in width. Further, the light emitting element and the photosensing element are arranged so that a light axis extending therebetween is parallel to the ejection opening array of the ink-jet head and so that the distance between the light emitting element and the photo-sensing element becomes greater than the range of the ejection opening array of the ink-jet head 5. By this, when the ejection opening array of the ink-jet head 5 is positioned corresponding to the light axis, all of ink droplets ejected from respective ejection openings may pass through the detection range between the light emitting element and the photo-sensing element. Thus, the photosensor 8 may output a value corresponding to number of ink droplets, namely number of ejection openings normally ejecting.

As set forth above, the photosensor 8 to be employed in the shown embodiment is the one similar to that discussed with respect to the prior art. Accordingly, due to fluctuation of characteristics of the photo-sensing element and the light emitting element of the sensor, play in assembling of these elements, and so forth, the sensor may have an error in output in the order of 20% at the maximum.

It should be noted that control of relative position between the ejection opening array of the ink-jet head and the light axis of the photosensor 8 is performed by employing a carriage home sensor 21 provided in the main body of the apparatus similar to positioning with the cap 20, set forth above. More specifically, a predetermined distance for shifting from the home position detected by the sensor 21 to the light axis of the photosensor is converted into number of steps of the motor for driving the carriage and preliminarily set the number of steps as a constant value in a sequence.

Next, discussion will be given for the major part of an electric circuit of the preferred embodiment of a facsimile apparatus with reference to a block diagram of FIG. 4.

Figure 4:
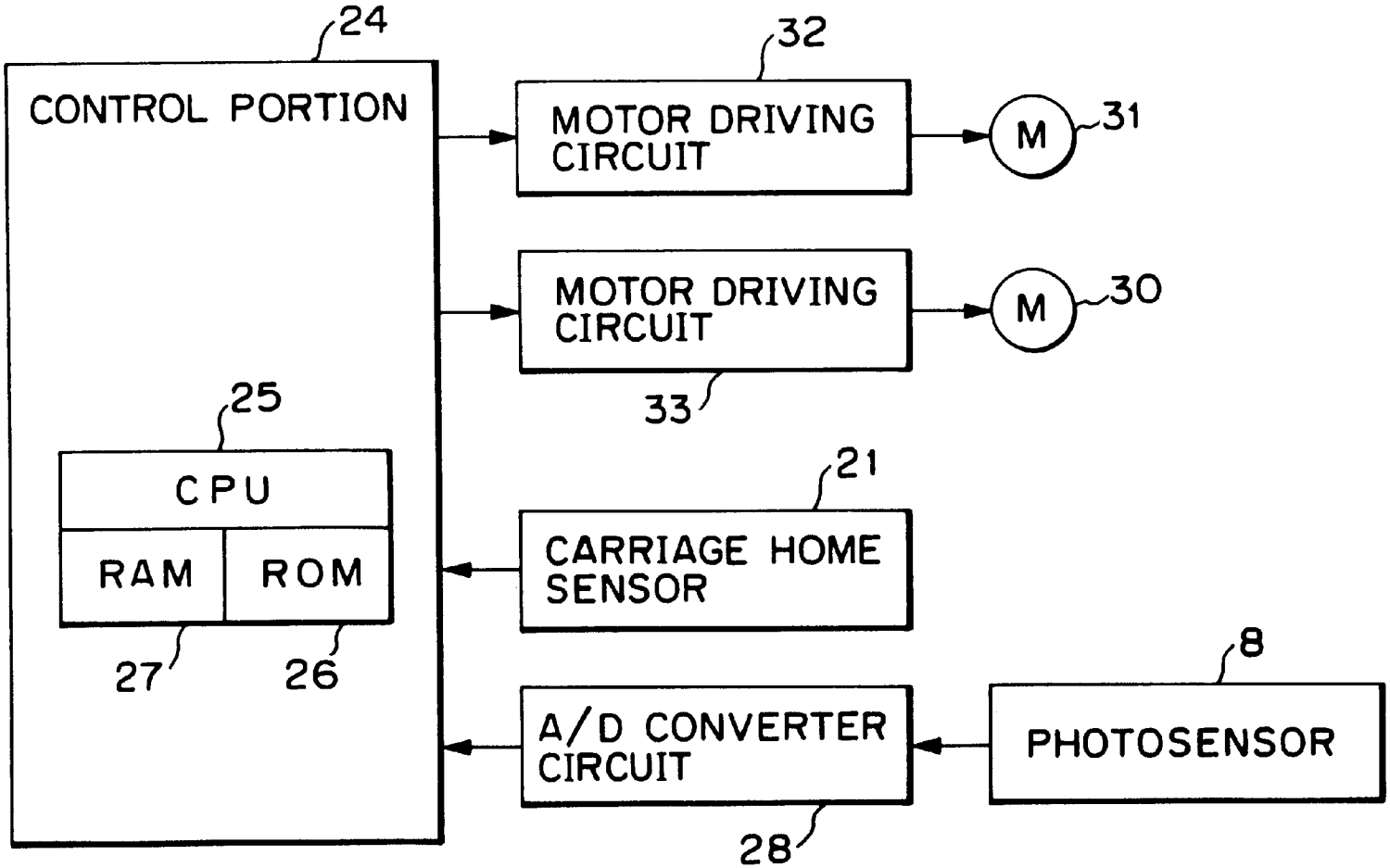
FIG. 4 is a block diagram showing a construction of a control system of the embodiment of the facsimile apparatus.

In FIG. 4, a reference numeral 24 denotes a control portion controlling overall the facsimile apparatus. The control portion 24 includes CPU 25, such as a microprocessor and so forth, ROM 26 for storing control programs to be executed by the CPU 25 and various data, RAM 27 to be used as work area of the CPU 25 and temporarily storing various data, and so forth. The control portion is formed as a circuit on a substrate in the apparatus. An output of the photosensor 8 is converted into a digital value by an A/D converter and can be subjected to processing of the CPU 2S. The carriage motor 30 and the feeder motor 31 are motors of which can be controlled a rotation angle by number of pulse steps issued by motor driver circuits 33 and 32, respectively, so that the CPU 25 can control rotation of motors 30 and 31. The output of the carriage home sensor 21 is input to the control portion 24 and used for controlling shifting of the ink-jet head.

In the construction set forth above, the detection of ink ejecting condition is performed for each ejection opening block consisting of 16 ejection openings out of 64 ejection openings in total as described later. Corresponding to this, an output value of the photosensor 8 when all 16 ejection openings normally eject ink is set in the control portion 24, e.g. in ROM 26. Thus, ejection failure is detected by comparing the actual output value of the photosensor 8 and the preliminarily stored value.

Figure 5:
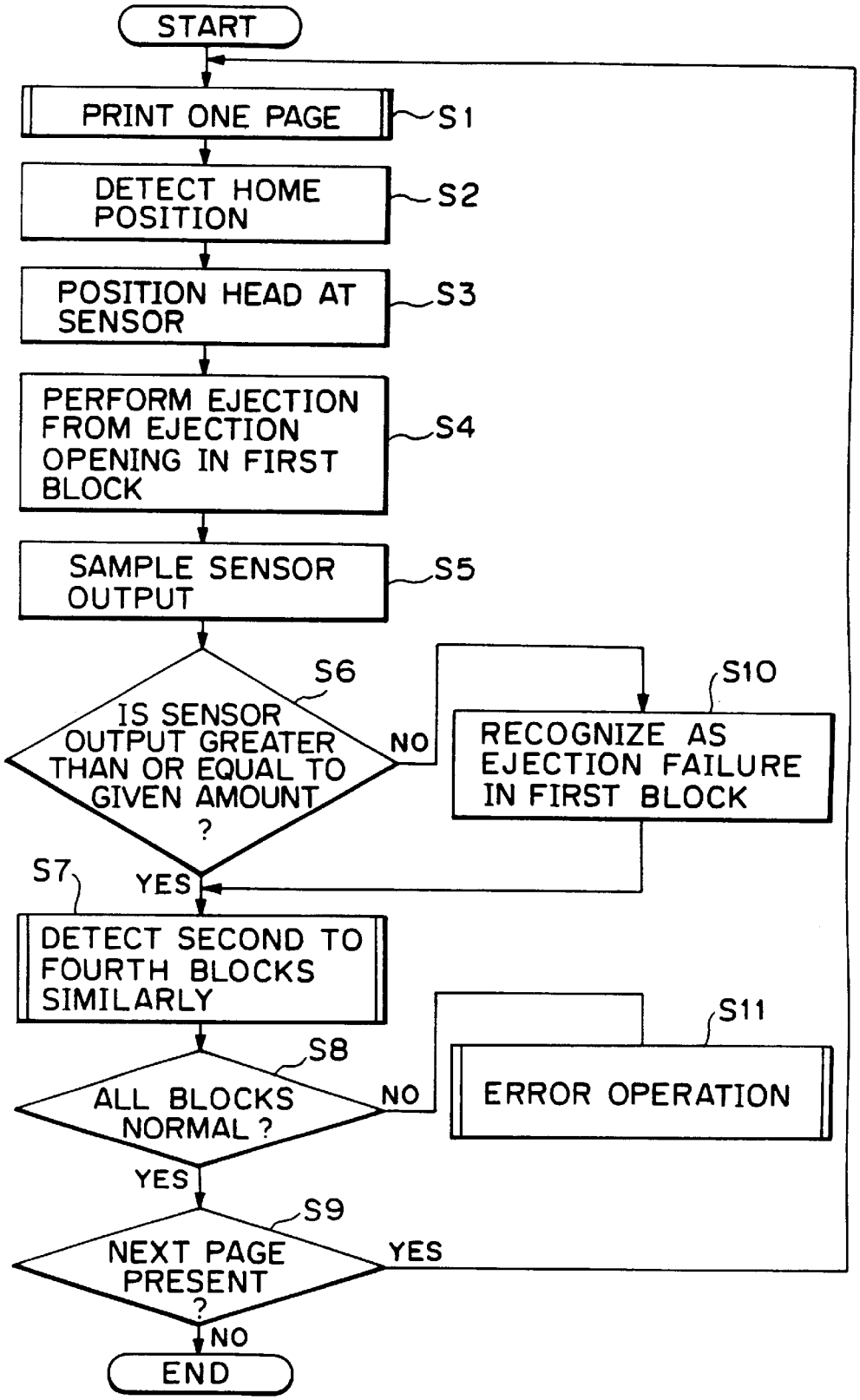
FIG. 5 is a flowchart showing a procedure of an ejection failure detecting process in a first embodiment according to the present invention.

FIG. 5 is a flowchart showing a sequence for detecting ejection failure in the construction of the preferred embodiment set forth above.

At first, in response to a printing instruction, one sheet of the printing paper P is picked up and fed to the printing portion B to perform printing of characters, image and so forth for one page (step S1). Subsequently, by shifting carriage 15, the carriage 15 at the home position (HP) is detected by the carriage home sensor 21 (step S2). Then, by shifting the carriage 15 in a predetermined magnitude from the home position, the position of the ejection opening array of the ink-jet head 5 is made to coincide with the detecting position of the photosensor 8 (step S3).

Next, instead of ejecting from all of 64 ejection openings, respective 10 ink droplets are ejected from respective ejection openings in a first block (first to sixteenth ejection openings from the end of the ejection opening array) of four blocks, each of which consists of 16 ejection openings corresponding to one fourth of 64 ejection openings in total (step S4). Then, during ejection, the output of the photosensor is sampled at fine time interval (100 Am) via the A/D converter (step S5). On the basis of the sampled data, judgment is made whether the output of the photosensor exceeds the preliminarily set given value or not (step S6). When the sampled data is smaller than the given value as judged, it is regarded that ejection failure state occurs in the first block (step S10).

Next, for a second block (seventeenth to thirty-second ejection-openings), a third block (thirty-third to forty-eighth ejection openings) and a fourth block (forty-ninth to sixty-fourth ejection openings), a detection sequence of ejection failure similar to the steps S4 to S6 and step S10 is performed sequentially (step S7).

As discussed above, when ejection is performed from 64 ejection openings at one time, it has been difficult to detect ejection failure in the ejection openings less than or equal to 12 ejection openings which is 20% of 64 of ejection openings. In contrast to this, by performing detection of ejection failure by dividing 64 ejection openings into four blocks, even with employing the same photosensor, it becomes possible to detect ejection failure in the ejection openings more than or equal to 4 ejection openings which is 20% of 16 ejection openings.

If judgment is made that ejection failure is caused in any block through the process set forth above (step S8), a predetermined error operation is executed (step S11). The error operation is, for instance, such that upon detection of ejection failure, the received data is stored in a memory, error indication is output, and then the printing operation is terminated. As a result of this, the received data are prevented from being lost so that a printing operation can be performed after an ejection recovery operation is performed.

On the other hand, if judgment is made that all of the blocks operate normally and a next page to be printed is present (step S8 and S9), picking-up of the next sheet is performed and the sequence returns to step S1 to repeat similar operations.

It should be noted that while the foregoing embodiment has been discussed in terms of that high speed sampling is performed by employing A/D converter circuit, it is also possible to employ a comparator circuit constituted of a relatively inexpensive operational amplifier instead of employing the A/D converter, to set a predetermined threshold value relative to the sensor output value so that a signal is fed to the control portion by comparing the sensor output with the threshold value.

Next, a principle of ejection of the ink-jet head to be employed in the printing portion in the shown embodiment of the ink-jet printing apparatus will be discussed.

The ink-jet head generally has a fine liquid ejection opening (orifice), a liquid passage (ink passage), an energy acting portion provided in a part of the liquid passage and an energy generating element for generating a thermal energy to act on the liquid in the energy acting portion. The ink-jet head is replaceably provided for the carriage.

As other energy generating elements for generating energy, one employing an electromechanical transducer, such as piezoelectric element, one irradiating an electromagnetic wave, such as laser or so forth to be absorbed by the liquid present therein to cause generation of heat and thus eject liquid droplet by action associated with heat generation to eject the liquid droplet, and so forth are known. Amongst these, a system for ejecting the liquid by a thermal energy generated by an electrothermal transducing element as employed in the shown embodiment, is suitable for high resolution printing since the liquid ejection openings (orifices) can be arranged at high density.

Further, the ink-jet head employing the electrothermal transducing element is easy to reduce a whole size, can take advantage of IC technology and/or micro-processing technology which are remarkable in advance of technology and in improvement of reliability in a recent semiconductor field, is satisfactorily effective, and is easily to make it into elongated or flat (two-dimensional) configuration to permit increasing number of ejection openings to easily achieve high package density. Furthermore, such ink-jet head has high mass-productivity and thus can be supplied at low production cost.

Such ink-jet head employing the electrothermal transducing element as the energy generating means and produced through semiconductor fabrication process generally has a construction, in which liquid passages are provided corresponding to respective ink ejection openings, the electrothermal transducing element as means for forming liquid droplet to fly by ejecting the liquid through the corresponding ink ejection opening by applying the thermal energy for the liquid filling respective liquid passage independently of each other. To respective liquid passages, the liquid is supplied from a common liquid chamber communicated with respective liquid passages.

Concerning production method of the ink-jet head, the assignee of the present application has proposed a method, in which at least a solid layer for forming the liquid passage, an active energy beam setting material layer to be at least used in formation of a peripheral wall of the liquid passage and a second substrate are stacked on a first substrate in order, thereafter, a mask is formed on the second layer to irradiate an active energy beam from the upper side of the mask for consolidating at least the portion forming the peripheral wall of the active energy beam setting material, further, the non-solidified portion of the active energy beam setting material layer is removed from the region between two substrates to form at least the liquid passages (see U.S. Pat. No. 5,030,317).

Second Embodiment

Figure 6:
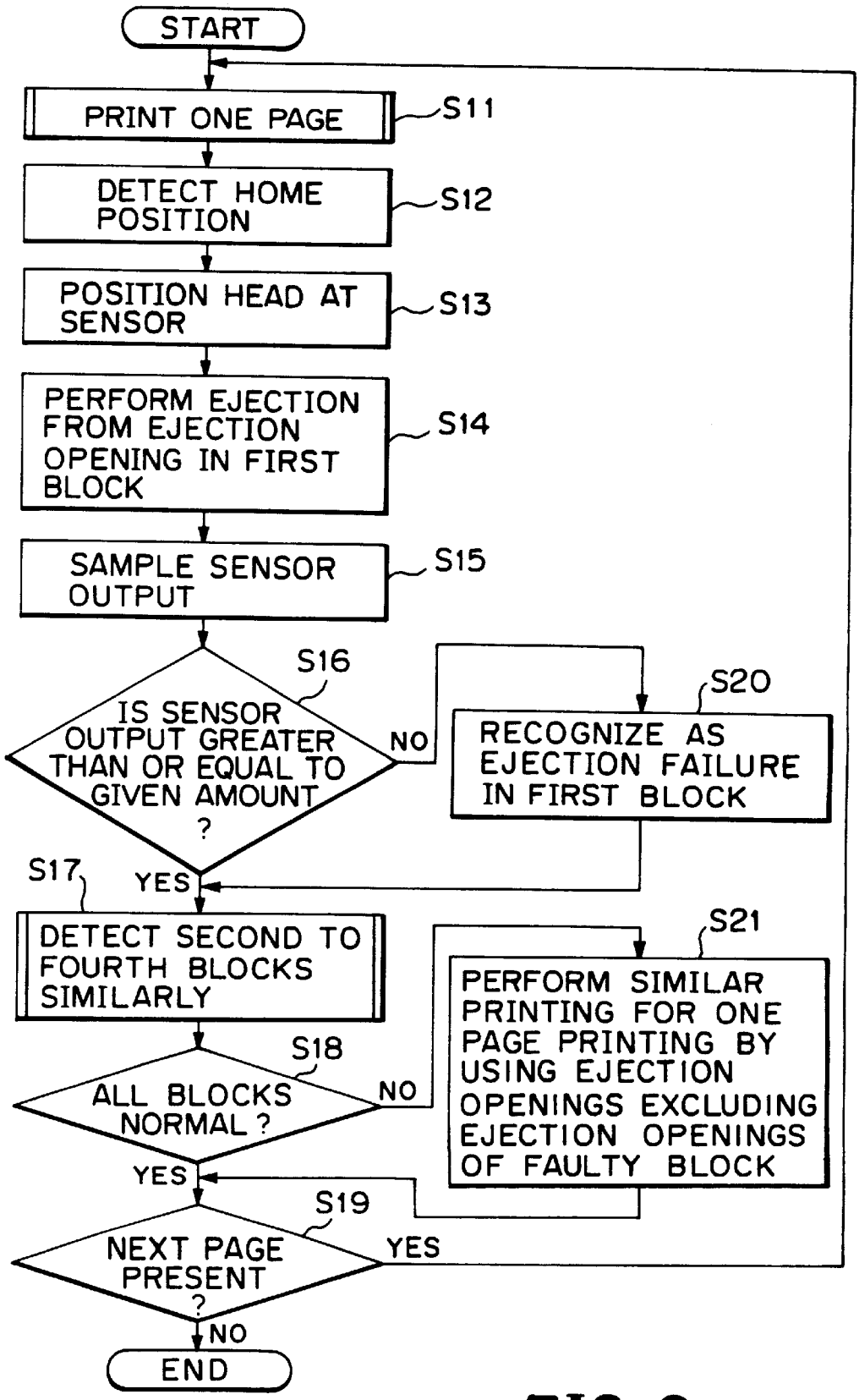
FIG. 6 is a flowchart showing a procedure of an ejection failure detecting process in a second embodiment according to the present invention.

FIG. 6 is a flowchart showing another embodiment of ejection failure detecting sequence which can be executed by the similar apparatus to that of the foregoing first embodiment.

In the process shown in FIG. 6, a process up to detection of ejection failure for respective blocks, namely the process of steps S11 to 17 and step 20 are similar to steps S1 to S7 and step S10 shown in FIG. 5 of the first embodiment. Only the process to be performed subsequently is differentiated. Hereinafter, the process of a feature of the shown embodiment will be discussed.

When judgment is made that ejection failure occurs in any one block, at step S18, the next printing paper is picked up at step S21 and fed into the printing portion B (see FIG. 2) for again performing printing for a first page only with the normal blocks excluding the block, in which ejection failure is caused. For example, when in the fourth block, ejection failure is caused, the ejection openings in the first to third blocks are used to eject the ink for printing. Then, per scanning cycle of the carriage, auxiliary scanning of the printing paper is performed in the magnitude corresponding to the ejection openings of the first to third blocks for forming the printed image. Similarly, in the subsequent printing, printing operation only with the normal blocks is continued until recovery operation for the ejection failure is performed.

It should be noted that when printing operation is performed only with the normal blocks as set forth above, it is of course necessary to adjust supply of ejection data. More specifically, in the process of step S21, only ejection data corresponding to the ejection openings in the first to third blocks is read out from a line memory, and in conjunction therewith, the ejection data for next one line is developed in the line memory corresponding to the normal blocks. Further, if ejection failure is caused in the second block, for example, it is possible to perform printing with the first, third and fourth blocks. However, in such case, two separate strip like regions of images are printed by one cycle of scanning and an adjustment of the ejection data is made relatively complex. Therefore, in such case, it is preferred to perform printing only with the ejection openings of the third and fourth blocks.

Also, while the foregoing embodiments have been discussed to perform detection ejection failure by dividing 64 ejection openings into four blocks, the number of the divided blocks is not specified and may be arbitrarily selected in view of the processing speed and so forth.

Further, although respective embodiments set forth above have been exemplarily discussed in terms of application for the facsimile apparatuses, the present invention is applicable not only for the facsimile but also in various printing apparatuses employing the ink-jet printing system. It is possible to apply the present invention for an ink-jet printer to be connected to a host apparatus, such as a computer or so forth for outputting image, character and so forth. In such case, it is desirable to perform detection of ejecting condition of the ink by the photosensor in advance of initiation of printing or in advance of initiation of printing per one page.

In the facsimile apparatus, since printing is performed with receiving the data transmitted through the telephone network and storing the received data in the memory, whether printing for one page is performed appropriately or not is checked after printing for one page. When inappropriate printing due to occurrence of ejection failure is detected, it is possible to interrupt printing and store data of the relevant page and subsequent pages in the memory for preventing loss of received data. In the printer performing printing with connecting to the host or so forth, it is easy to enter a command for re-output since the user is present in the vicinity of the apparatus. Also, by checking occurrence of ejection failure before printing one page, it is possible to detect ejection failure at earlier timing than checking after it becomes possible to eliminate a printing. By this, it becomes possible to eliminate a period of printing under the condition where the ejection failure occurs. In addition, the printing medium, such as the paper or so forth, can be saved. Therefore, detection of the ejecting condition in advance of printing is desired.

On the other hand, in the facsimile apparatus, there is apparatus having a printing portion which can be used as general printing portion. In such facsimile apparatus, in addition to a terminal for connection with telephone line, a terminal for connection with the computer or so forth is provided so as to achieve both functions as the facsimile apparatus and the printer by manual switching by the user or automatic switching by preferentially outputting the side from which data is transmitted.

Further, while the foregoing embodiments have been discussed for examples to perform monochrome printing with mounting one ink cartridge, in which a tank storing the ink and the printing head are integrated, the present invention is applicable for the printing apparatus mounting a plurality of cartridges corresponding to a plurality of colors of inks to form a color image.

On the other hand, in the facsimile apparatus which can be used as printer as set forth above, it becomes possible to form a black monochrome image when used as the facsimile and to form a color image when used as the printer by a construction exchangeably mounting the cartridge ejecting a single color ink and the cartridge storing a plurality of color inks for color printing. In such construction, it is possible that when the apparatus is used as the facsimile, detection of ejecting condition by the photosensor is performed every time of printing for one page, as set forth above, and when the apparatus is used as the printer, detection of the ejecting condition is not performed. Particularly, when the apparatus is used as the printer, commanding of outputting again is relatively earlier than that in the case of the facsimile apparatus. Therefore, by setting not to perform detection of ejecting condition, ink consumption can be restricted to lower running cost.

As set forth above, according to the shown embodiments, since detection of ejection failure of a plurality of ejection openings is performed with respect to each of divided blocks respectively consisting of the given number of ejection openings so that number of ejection openings for which ejection failure is checked can be reduced, even when error is present in the detection output of the detecting means, number of the ejection openings at which the result of detection of ejection failure becomes uncertain, can be reduced.

Further, even when ejection failure is detected, printing operation can be continued using the blocks other than faulty block. As a result, it becomes possible to provide the ink-jet printing apparatus and facsimile apparatus which are convenient in use.

The present invention achieves distinct effect when applied to a recording head or a recording apparatus which has means for generating thermal energy such as electrothermal transducers or laser light, and which causes changes in ink by the thermal energy so as to eject ink. This is because such a system can achieve a high density and high resolution recording.

A typical structure and operational principle thereof are disclosed in U.S. Pat. Nos. 4,723,129 and 4,740,796, and it is preferable to use this basic principle,to implement such a system. Although this system can be applied either to on-demand type or continuous type ink-jet recording systems, it is particularly suitable for the on-demand type apparatus. This is because the on-demand type apparatus has electrothermal transducers, each disposed on a sheet or liquid passage that retains liquid (ink), and operates as follows: first, one or more drive signals are applied to the electrothermal transducers to cause thermal energy corresponding to recording information; second, the thermal energy induces sudden temperature rise that exceeds the nucleate boiling so as to cause the film boiling on heating portions of the recording head; and third, bubbles are grown in the liquid (ink) corresponding to the drive signals. By using the growth and collapse of the bubbles, the ink is expelled from at least one of the ink ejection orifices of the head to form one or more ink drops. The drive signal in the form of a pulse is preferable because the growth and collapse of the bubbles can be achieved instantaneously and suitably by this form of drive signal. As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better recording.

U.S. Pat. Nos. 4,558,333 and 4,459,600 disclose the following structure of a recording head, which is incorporated to the present invention: this structure includes heating portions disposed on bent portions in addition to a combination of the ejection orifices, liquid passages and the electrothermal transducers disclosed in the above patents. Moreover, the present invention can be applied to structures disclosed in Japanese Patent Application Laying-open Nos. 123670/1984 and 138461/1984 in order to achieve similar effects. The former discloses a structure in which a slit common to all the electrothermal transducers is used as ejection orifices of the electrothermal transducers, and the latter discloses a structure in which openings for absorbing pressure waves caused by thermal energy are formed corresponding to the ejection orifices. Thus, irrespective of the type of the recording head, the present invention can achieve recording positively and effectively.

The present invention can be also applied to a so-called full-line type recording head whose length equals the maximum length across a recording medium. Such a recording head may consist of a plurality of recording heads combined together, or one integrally arranged recording head.

In addition, the present invention can be applied to various serial type recording heads: a recording head fixed to the main assembly of a recording apparatus; a conveniently replaceable chip type recording head which, when loaded on the main assembly of a recording apparatus, is electrically connected to the main assembly, and is supplied with ink therefrom; and a cartridge type recording head integrally including an ink reservoir.

It is further preferable to add a recovery system, or a preliminary auxiliary system for a recording head as a constituent of the recording apparatus because they serve to make the effect of the present invention more reliable. Examples of the recovery system are a capping means and a cleaning means for the recording head, and a pressure or suction means for the recording head. Examples of the preliminary auxiliary system are a preliminary heating means utilizing electrothermal transducers or a combination of other heater elements and the electrothermal transducers, and a means for carrying out preliminary ejection of ink independently of the ejection for recording. These systems are effective for reliable recording.

The number and type of recording heads to be mounted on a recording apparatus can be also changed. For example, only one recording head corresponding to a single color ink, or a plurality of recording heads corresponding to a plurality of inks different in color or concentration can be used. In other words, the present invention can be effectively applied to an apparatus having at least one of the monochromatic, multi-color and full-color modes. Here, the monochromatic mode performs recording by using only one major color such as black. The multi-color mode carries out recording by using different color inks, and the full-color mode performs recording by color mixing.

Furthermore, although the above-described embodiments use liquid ink, inks that are liquid when the recording signal is applied can be used: for example, inks can be employed that solidify at a temperature lower than the room temperature and are softened or liquefied in the room temperature. This is because in the ink-jet system, the ink is generally temperature adjusted in a range of 30° C.–70° C. so that the viscosity of the ink is maintained at such a value that the ink can be ejected reliably.

In addition, the present invention can be applied to such apparatus where the ink is liquefied just before the ejection by the thermal energy as follows so that the ink is expelled from the orifices in the liquid state, and then begins to solidify on hitting the recording medium, thereby preventing the ink evaporation: the ink is transformed from solid to liquid state by positively utilizing the thermal energy which would otherwise cause the temperature rise; or the ink, which is solid when left in air, is liquefied in response to the thermal energy of the recording signal. In such cases, the ink may be retained in recesses or through holes formed in a porous sheet as liquid or solid substances so that the ink faces the electrothermal transducers as described in Japanese Patent Application Laying-open Nos. 56847/1979 or 71260/1985. The present invention is most effective when it uses the film boiling phenomenon to expel the ink.

Furthermore, the ink-jet recording apparatus of the present invention can be employed not only as an image output terminal of an information processing device such as a computer, but also as an output device of a copying machine including a reader, and as an output device of a facsimile apparatus having a transmission and receiving function.

The present invention has been described in detail with respect to various embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

Although the invention has been illustrated and described with respect to exemplary embodiments thereof, it should be understood by those skilled in the art that the foregoing and various other changes, omissions and additions may be made therein and thereto, without departing from the spirit and scope of the present invention. Therefore the invention should not be understood as limited to the specific embodiment set out above to include all possible embodiments which can be embodied within a scope encompassed and equivalents thereof with respect to the feature set out in the appended claims.

What is claimed is:

1. An ink-jet printing apparatus for performing printing by ejecting an ink toward a printing medium by employing at least one ink-jet head on which a predetermined number of ink-jet openings are arranged, comprising:

detection means including a light emitting element and a photo-sensing element, said detection means for differentiating an output therefrom in accordance with an interrupting state of a light path formed between said light emitting element and said photo-sensing element;

control means for sequentially selecting, from one of the at least one ink-jet head, a group composed of a plurality of ejection openings and formed by dividing the predetermined number of ejection openings of the one ink-jet head, to cause the one ink-jet head to sequentially eject ink from all of the election openings of each selected group of ejection openings to the light path formed between said light emitting element and said photo-sensing element; and ejection failure determining means for determining an ejection failure state of each selected group of ejection openings based on the output from said detection means, the output being obtained when said control means causes each selected group of ejection openings to eject the ink, wherein said ejection failure determining means determines the ejection failure state of each selected group by determining whether any ejection opening composing a selected group is in an ejection failure state.

2. An ink-jet printing apparatus as claimed in claim 1, wherein said control means selects a block of ejection openings as the selected group of ejection openings from a plurality of blocks of ejection openings, the plurality of blocks being obtained by dividing the predetermined number of ejection openings of the ink-jet head into plural parts, each of which includes the plurality of ejection openings, and said ejection failure determining means determines the ejection failure state of each block of the plurality of blocks in response to ink ejection from each block, respectively.

3. An ink-jet printing apparatus as claimed in claim 2, wherein said detection means issues the output depending upon a number of ejection openings, among the plurality of ejection openings, which effect normal ejection of ink across the light path between said light emitting element and said photo-sensing element.

4. An ink-jet printing apparatus as claimed in claim 3, wherein said ink-jet head generates a bubble in the ink utilizing thermal energy and ejects the ink by generation of the bubble.

5. An ink-jet printing apparatus for performing printing by ejecting an ink toward a printing medium by employing at least one ink-jet head on which a predetermined number of ink-jet openings are arranged, comprising:

detection means including a light emitting element and a photo-sensing element, said detection means for differentiating an output therefrom in accordance with an interrupting state of a light path formed between said light emitting element and said photo-sensing element;

control means for sequentially selecting, from one of the at least one ink-jet head, a group composed of a plurality of ejection openings and formed by dividing the predetermined number of ejection openings of the one ink-jet head, to cause the one ink-jet head to sequentially eject ink from all of the election openings of each selected group of ejection openings to the light path formed between said light emitting element and said photo-sensing element;

ejection failure determining means for determining an ejection failure state of each selected group of ejection openings based on the output from said detection means, the output being obtained when said control means causes the selected ejection openings to eject the ink, wherein said ejection failure determining means determines the ejection failure state of each selected group by determining whether any ejection opening composing a selected group is in an ejection failure state; and printing control means for performing printing employing ejection openings other than the selected group of ejection openings, for which ejection failure is determined, when ejection failure is determined by said ejection failure determining means.

6. An ink-jet printing apparatus as claimed in claim 5, wherein said control means selects a block of ejection openings as the selected group of ejection openings from a plurality of blocks of ejection openings, the plurality of blocks being obtained by dividing the predetermined number of ejection openings of the ink-jet head into plural parts, each of which includes the plurality of ejection openings, and said ejection failure determining means determines the ejection state of each block of the plurality of blocks in response to ink ejection from each block, respectively, and said printing control means performs printing employing ejection openings of blocks other than the block where ejection failure is determined.

7. An ink-jet printing apparatus as claimed in claim 6, wherein said detection means issues the output depending upon a number of ejection openings, among the plurality of ejection openings, which effect normal ejection of ink across the light path between said light emitting element and said photo-sensing element.

8. An ink-jet printing apparatus as claimed in claim 7, wherein said ink-jet head generates a bubble in the ink utilizing thermal energy and ejects the ink by generation of the bubble.

9. A facsimile apparatus for performing printing on a basis of received data by employing at least one ink-jet head on which a predetermined number of ink ejection openings are arranged, comprising:

receiving means for receiving transmitted data as the received data;

detection means including a light emitting element and a photo-sensing element, said detection means for differentiating an output therefrom in accordance with an interrupting state of a light path formed between said light emitting element and said photo-sensing element;

control means for sequentially selecting, from one of the at least one ink-jet head, a group composed of a plurality of ejection openings and formed by dividing the predetermined number of ejection openings of the one ink-jet head, to cause the one ink-jet head to sequentially eject ink from all of the ejection openings of each selected group of ejection openings to the light path formed between said light emitting element and said photo-sensing element;

ejection failure determining means for determining an ejection state of each selected group of ejection openings based on the output from said detection means, the output being obtained when said control means causes the selected ejection openings to eject the ink, wherein said ejection failure determining means determines the ejection failure state of each selected group by determining whether any ejection opening composing a selected group is in an ejection failure state; and reception control means for storing the received data, received by said receiving means, in a memory after determining ejection failure, when ejection failure is determined by said ejection failure determining means.

10. A facsimile apparatus as claimed in claim 9, wherein said control means selects a block of ejection openings as the selected group of ejection openings from a plurality of blocks of ejection openings, the plurality of blocks being obtained by dividing the predetermined number of ejection openings of the ink-jet head into plural parts, each of which includes the plurality of ejection openings, and said ejection failure determining means determines the ejection failures state of each block of the plurality of blocks in response to ink ejection from each block, respectively.

11. A facsimile apparatus according to claim 10, wherein said detection means issues the output depending upon a number of ejection openings, among the plurality of ejection openings, which effect normal ejection of ink across the light path between said light emitting element and said photo-sensing element.

12. A facsimile apparatus as claimed in claim 11, wherein said ink-jet head generates a bubble in the ink utilizing thermal energy and ejects the ink by generation of the bubble.

13. A facsimile apparatus for performing printing on a basis of received data by employing at least one ink-jet head on which a predetermined number of ink ejection openings are arranged, comprising:

receiving means for receiving transmitted data as the received data;

detection means including a light emitting element and a photo-sensing element, said detection means for differentiating an output therefrom in accordance with an interrupting state of a light path formed between said light emitting element and said photo-sensing element;

first control means for sequentially selecting, from one of the at least one ink-jet head, a group composed of a plurality of ejection openings and formed by dividing the predetermined number of ejection openings of the one ink-jet head, to cause the one ink-jet head to sequentially eject ink from all of the ejection openings of each selected group of ejection openings to the light path formed between said light emitting element and said photo-sensing element;

ejection failure determining means for determining an ejection failure sate of each selected group of ejection openings based on the output from said detection means, the output being obtained when said first control means causes each selected group of ejection openings to eject the ink, wherein said ejection failure determining means determines the ejection failure state of each selected group by determining whether any ejection opening composing a selected group is in an ejection failure state; and second control means for performing printing by employing ejection openings other than the selected group of ejection openings at which ejection failure is determined and storing the received data, received by said receiving means, in a memory after determining ejection failure, when ejection failure is determined by said ejection failure determining means.

14. A facsimile apparatus as claimed in claim 13, wherein said first control means selects a block of ejection openings as the selected group of ejection openings from a plurality of blocks of ejection openings, the plurality of blocks being obtained by dividing the predetermined number of ejection openings of the ink-jet head into plural parts, each of which includes the lesser number of ejection openings, and said ejection failure detecting means detects the ejection state of each block of the plurality of blocks in response to ink ejection from each block, respectively, and said second control means performs printing employing ejection openings of blocks other than the block where ejection failure is detected.

15. A facsimile apparatus as claimed in claim 14, wherein said detection means issues the output depending upon a number of ejection openings, among the plurality of ejection openings, which effect normal ejection of ink across the light path between said light emitting element and said photo-sensing element.

16. A facsimile apparatus as claimed in claim 15, wherein said ink-jet head generates a bubble in the ink utilizing thermal energy and ejects the ink by generation of the bubble.

17. An ejection state detecting method for an ink-jet printing apparatus for performing printing by ejecting ink toward a printing medium by employing at least one ink-jet head on which a predetermined number of ink-jet openings are arranged, the apparatus including detection means having a light emitting element and a photo-sensing element, the detection means differentiating an output therefrom in accordance with an interrupting state of a light path formed between the light emitting element and the photo-sensing element, said method comprising the steps of:

sequentially selecting, from one of the at least one ink-jet head, a group composed of a plurality of ejection openings and formed by dividing the predetermined number of ejection openings of the one ink-jet head to cause the one ink-jet head to sequentially eject the ink from all of the ejection openings of each selected group of ejection openings to the light path formed between the light emitting element and the photo-sensing element; and determining an ejection failure state of each selected group of ejection openings based on the output from the detection means, the output being obtained when the selected group of ejection openings is caused to eject the ink, wherein said ejection failure determining step determines the ejection failure state of each selected group by determining whether any ejection opening composing a selected group is in an ejection failure state.

18. An ejection state detecting method as claimed in 17, further comprising the step of:

performing printing by employing ejection openings other than the selected group of ejection openings, for which ejection failure is determined, when ejection failure is determined in said ejection failure determining step.

19. An ejection state detecting method as claimed in claim 17, wherein said selecting step selects a block of ejection openings as the selected group of ejection openings from a plurality of blocks of ejection openings, the plurality of blocks being obtained by dividing the predetermined number of ejection openings of the ink-jet head into plural parts, each of which includes the plurality of ejection openings, and said ejection failure determining step determines the ejection failure state of each block of the plurality of blocks in response to ink ejection from each block, respectively.

20. An ejection state detecting method as claimed in claim 19, wherein the detection means issues the output depending upon a number of ejection openings, among the plurality of ejection openings, which effect normal ejection of ink across the light path between said light emitting element and said photo-sensing element.

21. An ejection state detecting method as claimed in claim 20, wherein the ink-jet head generates a bubble in the ink utilizing thermal energy and ejects the ink by generation of the bubble.

* * * * *

UNITED STATES PATENT AND TRADEMARK OFFICE

CERTIFICATE OF CORRECTION

PATENT NO. : 6,322,190 B1
DATED : November 27, 2001
INVENTOR(S) : Kono et al.

It is certified that error appears in the above-identified patent and that said Letters Patent is hereby corrected as shown below:

Title page,
Item [56], References Cited, FOREIGN PATENT DOCUMENTS, "1310965" should read -- 1-310965 -- and "(JP 1-310,965), 12/15/8*" should read -- (JP 1-310965), 12/15/89* --.

Column 1,
Line 38, "into" should read -- ink --.

Column 2,
Line 13, "Am." should read -- $\mu$m. --.

Column 3,
Line 16, "inhibit" should be deleted, and "data" should read -- data is inhibited --.
Line 17, "perform operation accumulating" should read -- cause accumulation of --.

Column 6,
Line 14, "is" should read -- has --.

Column 7,
Line 66, "CPU 2S." should read -- CPU 25. --.

Column 9,
Line 41, "easily" should read -- easy -- and "it" should be deleted.

Column 16,
Line 19, "failures" should read -- failure --.
Line 53, "sate" should read -- state --.

Column 12,
Line 10, "principle, to" should read -- principle to --.

UNITED STATES PATENT AND TRADEMARK OFFICE

CERTIFICATE OF CORRECTION

PATENT NO. : 6,322,190 B1
DATED : November 27, 2001
INVENTOR(S) : Kono et al.

It is certified that error appears in the above-identified patent and that said Letters Patent is hereby corrected as shown below:

Column 13,
Line 30, "temperature adjusted" should read -- temperature-adjusted --.

Column 14,
Line 23, "election" should read -- ejection --.

Signed and Sealed this

Twenty-third Day of September, 2003

JAMES E. ROGAN
*Director of the United States Patent and Trademark Office*